US011034490B2

(12) United States Patent
Morris, III et al.

(10) Patent No.: US 11,034,490 B2
(45) Date of Patent: Jun. 15, 2021

(54) CHILD RESISTANT PACKAGING

(71) Applicant: IV Thought Products & Design, Corp., Buffalo, NY (US)

(72) Inventors: Samuel L. Morris, III, Buffalo, NY (US); Scott Freyn, Arkport, NY (US)

(73) Assignee: IV THOUGHT PRODUCTS & DESIGN, CORP., Buffalo, NY (US)

( * ) Notice: Subject to any disclaimer, the term of this patent is extended or adjusted under 35 U.S.C. 154(b) by 113 days.

(21) Appl. No.: 16/265,118

(22) Filed: Feb. 1, 2019

(65) Prior Publication Data

US 2020/0247593 A1 Aug. 6, 2020

(51) Int. Cl.
*B65D 50/04* (2006.01)

(52) U.S. Cl.
CPC ..... *B65D 50/043* (2013.01); *B65D 2215/02* (2013.01)

(58) Field of Classification Search
CPC .. B65D 50/043; B65D 2215/02; B65D 55/02; B65D 55/04; B65D 55/10; B65D 50/046
USPC ..... 220/288
See application file for complete search history.

(56) References Cited

U.S. PATENT DOCUMENTS 5,562,218 A * 10/1996 Hamilton ..... B65D 50/046 215/221
5,609,263 A * 3/1997 Perchepied ..... B65D 41/3447 215/252
2010/0200533 A1* 8/2010 Rice ..... B65D 50/046 215/216

* cited by examiner

*Primary Examiner* — James N Smalley
*Assistant Examiner* — Madison L Poos
(74) *Attorney, Agent, or Firm* — Roach Brown McCarthy & Gruber P.C.; Kevin D. McCarthy

(57) ABSTRACT

A child-resistant packaging is provided for storing and securing pharmaceuticals, drugs, nutraceutical products, medications, cannabis products and other hazardous materials which are vulnerable to access by the children. The packaging comprises a container, a cap and a depressor to lock the cap with the container or unlock the cap from the container. The container comprises a fixed circumferential ring along an elongated hollow neck having relief cut-outs and hinges to provide depression for a plurality of container lugs. The cap comprises an elongated hollow neck having a plurality of cap lugs towards its open end. The depressor is forced the container lugs inwards in the body of the container and the cap lugs are locked with the container lugs.

12 Claims, 7 Drawing Sheets

CHILD RESISTANT PACKAGING

TECHNICAL FIELD

The present invention relates generally to closures for containers, and more particularly to a closure with a child-resistant feature.

BACKGROUND

Pharmaceuticals and drugs packaging are very important in view of (a) environmental protection issues, (b) protection from being damaged and (c) child-resistant protection issues. Containers with particularly hazardous materials, such a pharmaceutical, are vulnerable to access by children which can lead to harm to the child if the child (i) is able to open the container and (ii) consumes the contents.

To prevent or inhibit access to a container, many closures incorporate child-resistant features. Many different types of child-resistant container have been proposed. One of the most common child-resistant containers uses a cap and container construction that requires a user to press down on the cap while turning to cause locking tabs to disconnect. Once the locking tabs are disconnected the cap can be removed.

These "child-resistant" containers are typically used for over-the-counter and prescription medications. Other child-resistant containers are used for other household items, that are toxic if swallowed or ingested. These containers are in place to prevent children from inadvertently gaining access to the contents of these containers.

However, these child resistant containers include a multi-step opening and closing process. A certain level of mental and physical dexterity is required for opening and closing such containers. For example, use of a certain amount of pressure or force is needed to open the container, which inhibits children from being able to open.

It is therefore a press-down design is fine for removable lids. However, adding child resistant features to a flip top lid has been difficult since the lid is secured at one side and, thus, cannot be twisted to unlock tabs.

Also, many child-resistant features make the container difficult to open for anyone with limited dexterity, such as arthritic patients or disabled person or use by the elderly people.

Further, these child resistant containers are also often inadequate to protect the contents from degradation upon exposure to environmental factors such as moisture, temperature or air.

Since the container body and the closure cap is made of synthetic resin, such as turning in with excessive force, there is a possibility that the engaging protrusion is deformed or damaged.

A challenge in creating child resistant containers is making the container easy enough for the arthritic patients or disabled persons or use by the elderly people.

A need, therefore, exists for a container which is child resistant and is easily manipulated between an open position and a close position for a non-child.

Therefore, there remains a need for improved containers that are easy to use for an elderly or disabled individual or arthritic patients, while providing child-resistant features. Also, there remains a need for a container where the contents are protected for improved shelf-life, such as being liquid-tight, air-tight, moisture-tight.

One goal of the present invention is to provide a container with a press-open cap in which the container and the cap engages firmly with each other to inhibit unnecessary opening of the cap, and where a minimal given force is applied in an opening mechanism, releases the engagement to inhibit the breakage of the cap.

Another goal of the present invention is to provide (a) child-resistant packaging for pharmaceuticals, drugs, nutraceutical products, medications, cannabis products and other products that could be deemed undesirable for children and (b) a simple, easy to configure packaging that can accommodate different types of products and packaging requirements.

SUMMARY OF THE INVENTION

The present invention provides a child-resistant packaging having a closure for a container that forms a two-piece child-resistant closure and have flexible and fixed lugs performing a locking function.

In one aspect of the present invention, the child-resistant packaging for storing and securing of pharmaceuticals, drugs, nutraceutical products, medications, cannabis products and other products that could be deemed undesirable for children. The child-resistant packaging has a container with an elongated hollow neck and an extended bottom surface, a cap with an elongated hollow neck and closed top, wherein, the extended bottom surface of the container is a fixed circumferential ring along the elongated neck and provided with relief cut-outs to provide a depression for plurality of lugs provided on the surface perpendicular to the elongated neck and the elongated hollow neck of the cap have plurality of lugs towards its open end. The depressions are provided on the extended bottom surface to give a mark for applying forces towards relief cut-outs. Further, locking threads are provided on outer circumference of the elongated neck to lock it with its counterpart.

In another aspect of the present invention, container is a molded body made up of material such as but not limited to thermoplastics, such as and not limited to polypropylene. The container body is circular in shape with an elongated hollow neck and an extended bottom surface. The extended bottom surface is a fixed circumferential ring with the elongated neck and provided with relief cut-outs to provide the depression for plurality of lugs provided on the surface perpendicular to the elongated neck. The provided lugs have an angled/tapered surface and a straight surface. Further, locking threads are provided on outer circumference of elongated neck/cap to lock it with its counterpart.

In another aspect of the present invention, the cap is a molded body made up of material such as but not limited to thermoplastics, such as and not limited to polypropylene. The cap body is circular in shape with an elongated hollow neck and closed top. The elongated hollow neck has locking threads on inner circumference to lock it with its counterpart and have plurality of lugs towards its open end. The lugs have an angled/tapered surface and a straight surface.

In another aspect of the present invention, the cap lugs can be attached into the elongated neck of the cap using (a) polymeric adhesives like and not limited to epoxy, araldite, and combinations thereof or (b) screws, pins, bolts, or equivalents thereof made of plastic or metal. In such case the lugs will be provided with locator/attachment pins that slide into matching holes provided in the elongated neck of the cap.

In another aspect of the present invention, the cap lugs can be separately molded forming a ring and can be attached, as identified above, into the elongated neck of cap. In such case the elongated neck of the cap is provided with thinned out portion at its opening in which lug ring will be inserted then adhered and press fitted.

In another aspect of the present invention, in operation, the cap will be screwed to close the container, the angled/tapered surface of the cap lugs will make contact with the angled/tapered face of the container's lugs and force the depressor area and container's lugs inwards of the body of the container and as it passes the container's lug it gets locked. Once the straight surface of lugs of both parts are in contact, anti-rotation is prohibited.

In another aspect of the present invention, to unlock the packaging, a depressor/pushing button on the container have to push inward which permits the lugs to pass by each other so that the cap can screwed off. The depressor/pushing button will move into the cut out in elongated neck of container and allows unlock the cap. The relief cut-out allows the depressor/pushing button to move inward to release the cap lugs from the container's lugs. The relief cut-out causes the depressor/pushing button to only be attached by a living hinge that provides enough flexibility. The living hinge flexes when the depressor/pushing button is pushed inward. The living hinge further aids in bending of the depressor/pushing button when it is pushed. It is designed to ensure that the button/depressor area flexes in evenly and doesn't twist.

It is an object of the present invention is the child-resistant packaging for storing and securing of pharmaceuticals products, medications and drugs.

It is another object of the present invention is the child-resistant packaging for storing and securing nutraceutical products.

It is another object of the present invention is the child-resistant packaging for cannabis products.

It is another object of the present invention is the child-resistant packaging for hazardous materials which are vulnerable to access by the children.

BRIEF DESCRIPTION OF THE DRAWINGS

The object of the invention may be understood in more details and more particularly description of the invention briefly summarized above by reference to certain embodiments thereof which are illustrated in the appended drawings, which drawings form a part of this specification. It is to be noted, however, that the appended drawings illustrate preferred embodiments of the invention and are therefore not to be considered limiting of its scope, for the invention may admit to other equally effective equivalent embodiments.

DETAILED DESCRIPTION OF THE INVENTION

The present invention will now be described more fully hereinafter with reference to the accompanying drawings in which a preferred embodiment of the invention is shown. This invention may, however, be embodied in many different forms and should not be construed as being limited to the embodiment set forth herein. Rather, the embodiment is provided so that this disclosure will be thorough, and will fully convey the scope of the invention to those skilled in the art.

Figure 1:
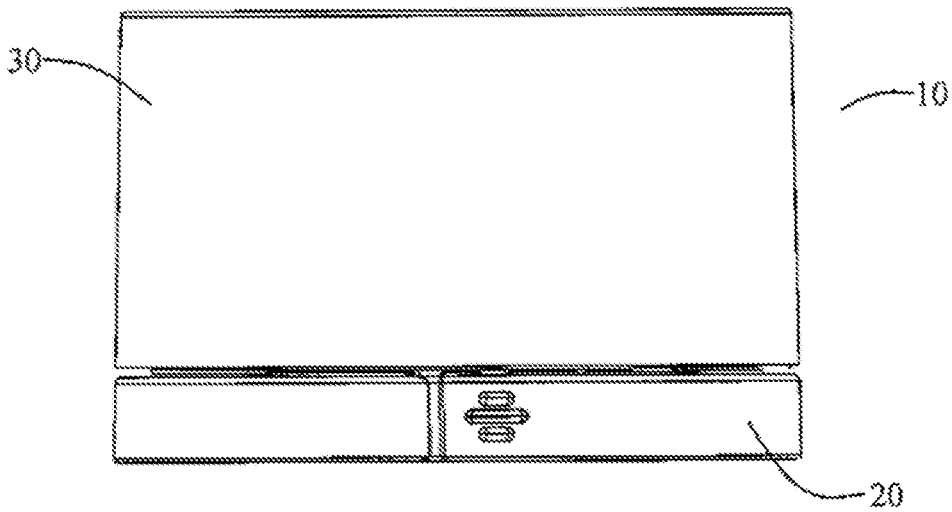
FIG. 1 shows a child-resistant packaging in accordance with an embodiment of the present invention.
Figure 2:
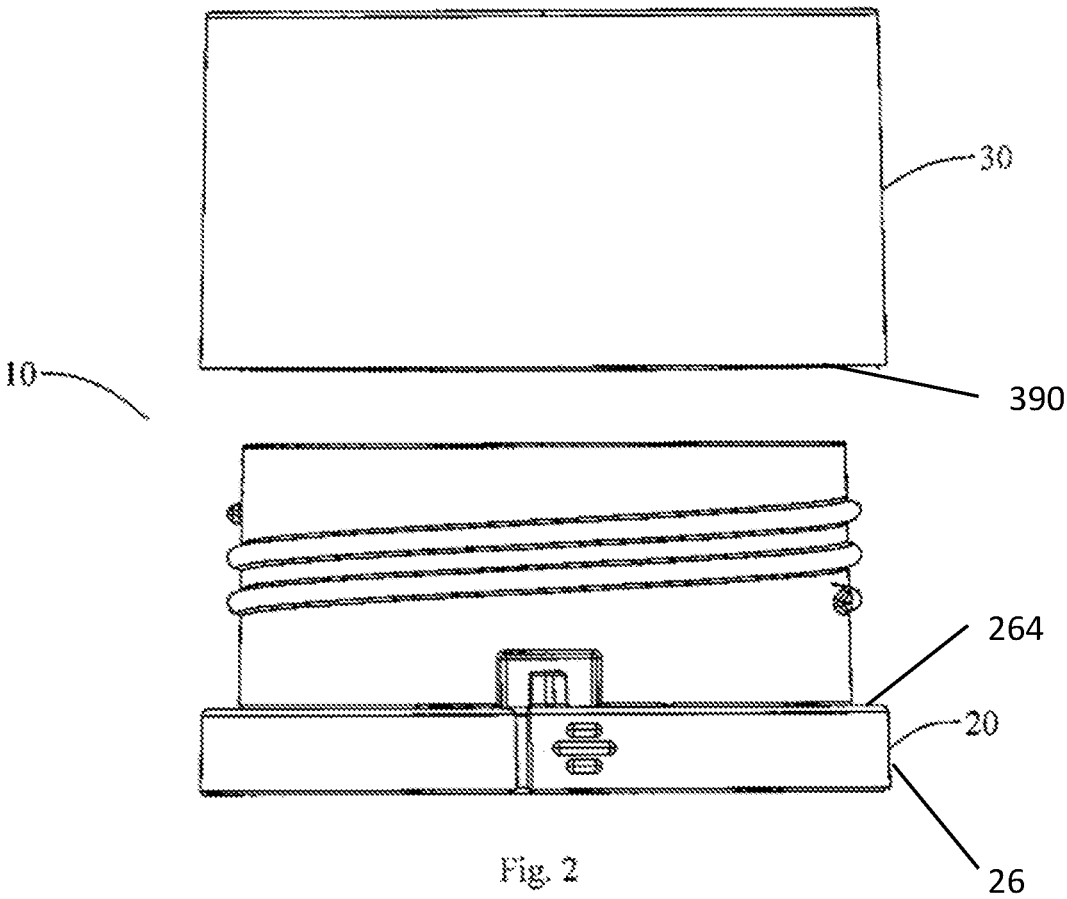
FIG. 2 shows an exploded view of a child-resistant packaging in accordance with an embodiment of the present invention.

FIG. 1 and FIG. 2 illustrate collapsed and exploded views of a child-resistant packaging 10. The packaging 10 has a container/jar 20 and a cap 30 that form a two-piece child-resistant closure for a container. The container/jar 20 and the cap 30, each has flexible and fixed lugs that perform a locking function. The container 20 and the cap 30 is a molded body made up of material such as but not limited to thermoplastics such as and not limited to polypropylene, acrylic, acrylonitrile butadiene styrene, chlorinated polyvinyl chloride, polyamides, aliphatic polyesters, polybenzimidazole, polycarbonate, polysulfone, polyacetal, polyaryletherketone, polyethylene, polystyrene, polyvinyl chloride, plytetrafluoroethylene and combinations thereof.

Figure 3:
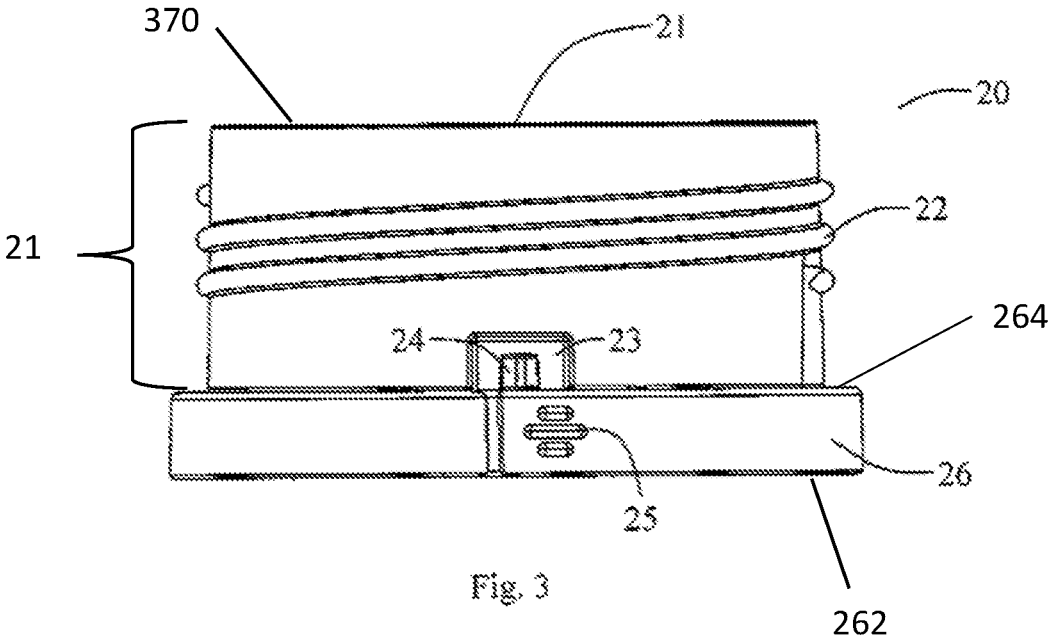
FIG. 3 shows a top view of a container of a child-resistant packaging with Depressor/pushing button in accordance with an embodiment of the present invention.
Figure 4:
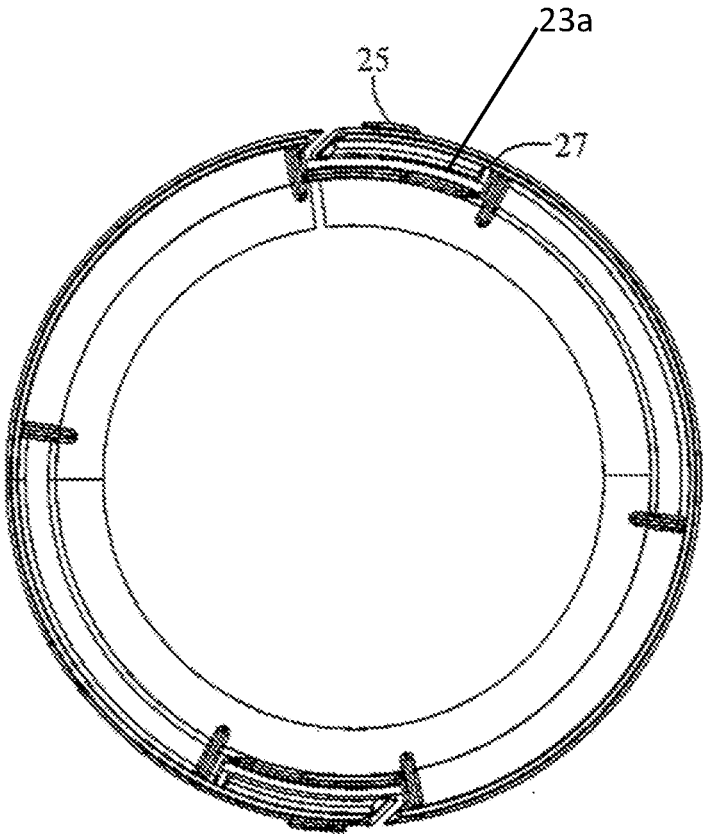
FIG. 4 shows a bottom view of a container of a child-resistant packaging in accordance with an embodiment of the present invention.

FIG. 3 and FIG. 4 illustrate the container 20 of a child-resistant packaging 10. The container 20 body has a storage cavity 370 defined by a cylindrical elongated hollow neck 21 and an extended, closed bottom surface 26. The extended bottom surface 26 is a fixed circumferential ring having a distal surface 262 and a proximal surface 264. The distal surface 262 and the proximal surface 264, each has a larger circumference than the elongated neck 21. The circumference of the distal surface 262 can be the same or different than the circumference of the proximal surface 264. In any case, the circumference of the proximal surface 264 is designed such that the cap's bottom surface 390, when properly locked to the hollow neck 21, contacts or nearly contacts at least a portion of the container's proximal surface 264.

The extended bottom surface 26, as illustrated at FIG. 4, has at least one living hinge 27—two are illustrated at FIG. 4. The living hinge 27 is positioned in an extended bottom surface cavity 23*a*. The extended bottom surface cavity 23*a* corresponds with a hollow neck cavity 23 wherein the cavities 23*a* and 23 are aligned in the same area together. Positioned in the hollow neck cavity 23 is at least one lug 24, preferably a plurality of lugs 24. A portion of the lug(s) 24 and a portion of the hollow neck cavity 23 are both positioned above the proximal surface 264. The lug(s) 24 are positioned so the lug(s) 24 contacts the cap 30 when the cap 30 is securely locked to the container 20.

The living hinge 27 has a depressor/pushing button 25. The extended bottom surface cavity 23*a* and the corresponding hollow neck cavity 23 each has a predetermined depth and the living hinge 27 has sufficient flexibility to permit most non-children users to apply at least a predetermined pressure toward the elongated neck's center upon the depressor/pushing button 25. The living hinge 27 flexes when the depressor/pushing button is pushed inward. The living hinge 27 further aids in bending of the depressor/pushing button 25 when it is pushed. It is designed to ensure that the button/depressor button is able to flex in evenly and doesn't twist when the predetermined pressure is applied. When the predetermined pressure is applied, the living hinge 27 contacts the elongated neck's wall which results in the container lug(s) 24 transitionally moving toward the elongated neck's center being in an unlocking state position. And when the predetermined pressure is not applied to the living hinge 27, the lug(s) 24 revert to a locking state position.

Locking threads 22 are also provided on outer diameter of the elongated neck 21 to lock it with its counterpart—the cap 30 when the cap 30 is at least securely positioned on the container 20.

Figure 5:
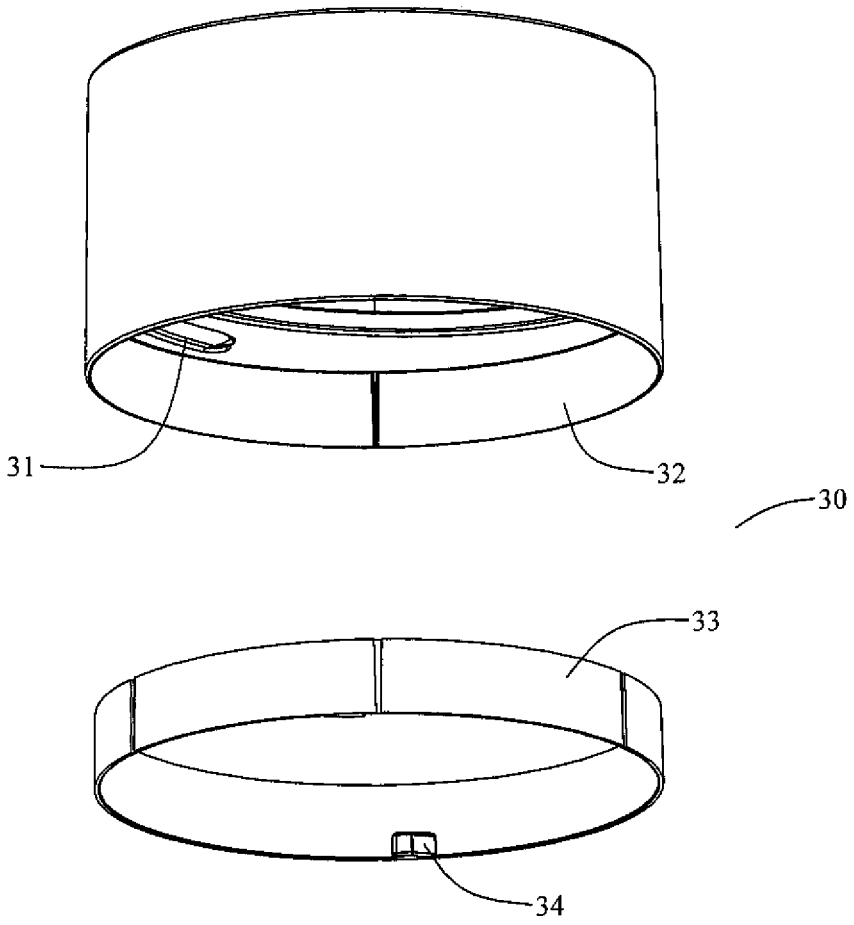
FIG. 5 shows the exploded view of a cap with lug ring for a child-resistant packaging in accordance with an embodiment of the present invention.

FIG. 5 illustrates an exploded view of the cap 30 having an elongated hollow neck 302 a proximal closed top 304, and a distal opening 306. The elongated hollow neck 302 has locking threads 31 on its inner diameter to lock it with its counterpart—the locking threads on the container's outer diameter of the elongated neck 21. In all embodiments, the cap 30 has at least one cap lug 34 positioned near the distal opening 306 so that when cap 30 is securely attached to container 20 that cap lug(s) 34 and container lug(s) 24 are aligned in such a way that cap lug(s) 34 and container lug(s) 24 inhibit, unless a sufficient force is applied to the living hinge 27 and simultaneously the cap 30 is unthreaded from the container 20, the cap 30 from being unattached to the container 20.

In one embodiment, the cap's elongated neck 302 has a thinned-out portion 32. The thinned-out portion 32 is provided at and near the distal opening 306. The thinned-out portion is designed to receive a lug ring 33. The lug ring 33 can be inserted into the thinned out portion 32 and attached thereto. For example, the attaching process can be accomplished by applying an adhesive (polymeric adhesives like and not limited to epoxy, araldite, and combinations thereof) to the thinned-out portion's interior wall surface 322, the lug ring's exterior surface 332, or both surfaces 322, 332, then inserting the lug ring into the thinned out portion and press fitting the lug ring and the thinned out portion together. Alternatively, the lug ring 33 can be attached to the thinned-out portion's interior wall surface 322 by screws, pins, bolts, or equivalents thereof made of plastic or metal; or combinations with the above-identified polymeric adhesives thereof.

The lug ring 33 has the at least one cap lug(s) 34. The cap lug(s) 34 can be an integral molded portion of the lug ring 33 or separately molded and can be attached onto the lug ring 33. The cap lug(s) 34 can be attached into the lug ring 33 using (a) polymeric adhesives like and not limited to epoxy, araldite, and combinations thereof, (b) screws, pins, bolts, or equivalents thereof made of plastic or metal; or (c) combinations thereof.

Figure 6:
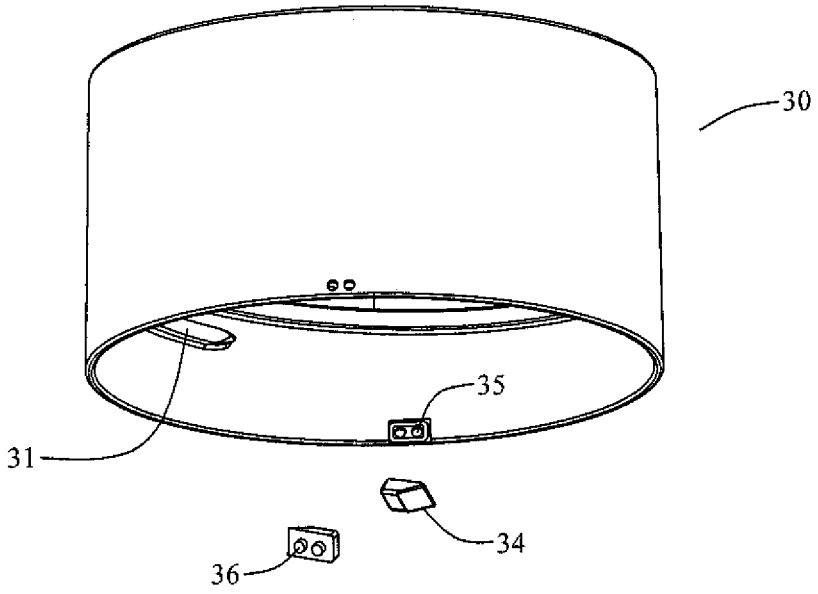
FIG. 6 shows the exploded view of another cap with means of attaching lugs for a child-resistant packaging in accordance with an embodiment of the present invention.

FIG. 6 illustrates the exploded view of another embodiment of cap 30 having an elongated hollow neck and closed top. The elongated hollow neck 302 has locking threads 31 on its inner diameter to lock it with its counterpart—container 20. The cap 30 also has the at least one cap lug(s) 34. The at least one cap lug(s) 34 can be an integral molded portion of the cap 30 or, as shown in FIG. 6, separately molded and adhered onto the elongated neck of cap 30. The cap lug(s) 34 can be attached into the elongated neck of the cap using (a) polymeric adhesives like and not limited to epoxy, araldite, and combinations thereof or (b) screws, pins, bolts, or equivalents thereof made of plastic or metal; or (c) combinations thereof.

As illustrated at FIG. 6, the cap's elongated hollow neck 302 can have a plurality of lug cavities 35. The lug cavities 35 are configured to receive at least one locator/attachment pin(s) 36 protruding from the cap lug(s) 34 rear surface 350. In addition to the 0 connection of the lug cavities 35 and locator/attachment pin(s), the cap lug(s) 34 can be attached into the elongated neck of the cap using (a) polymeric adhesives like and not limited to epoxy, araldite, and combinations thereof or (b) screws, pins, bolts, or equivalents thereof made of plastic or metal; or (c) combinations thereof. As set forth above, the cap lug(s) 34 and container lug(s) 24 are designed to inhibit, unless a sufficient force is applied to the living hinge 27 and simultaneously the cap 30 is unthreaded from the container 10, the cap 30 from being unattached to the container 10

Figure 7:
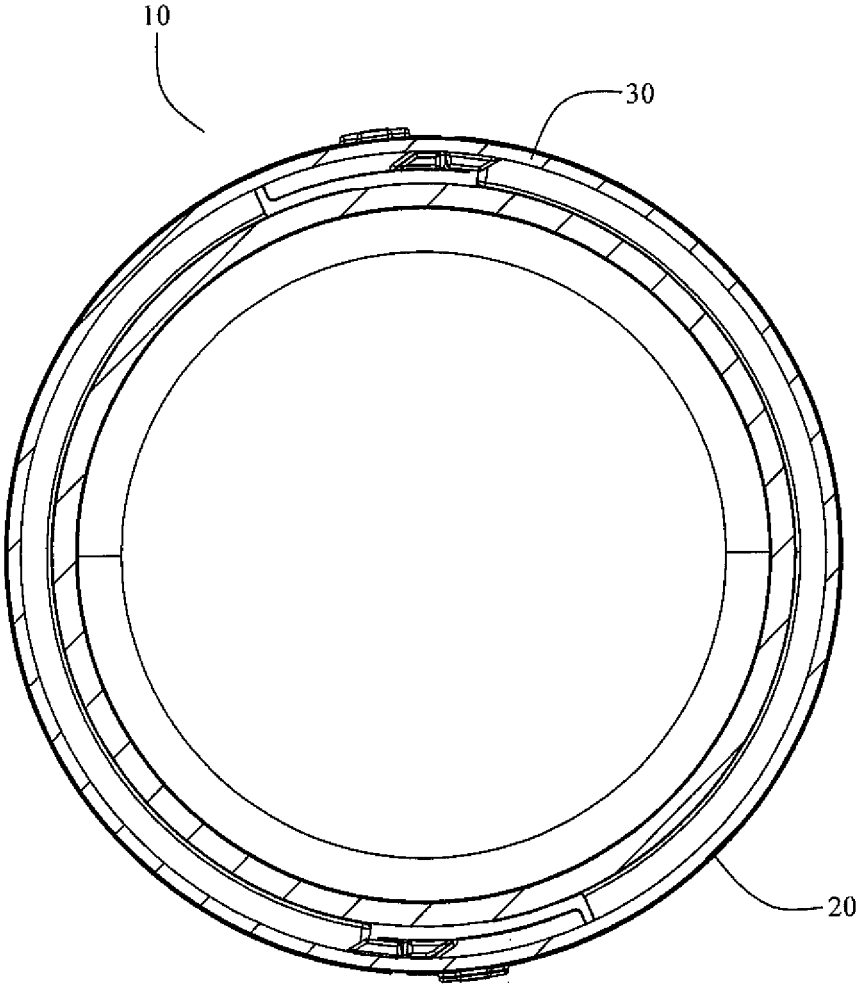
FIG. 7 shows the sectional view of assembled container with a cap of a child-resistant packaging in accordance with an embodiment of the present invention.
Figure 8:
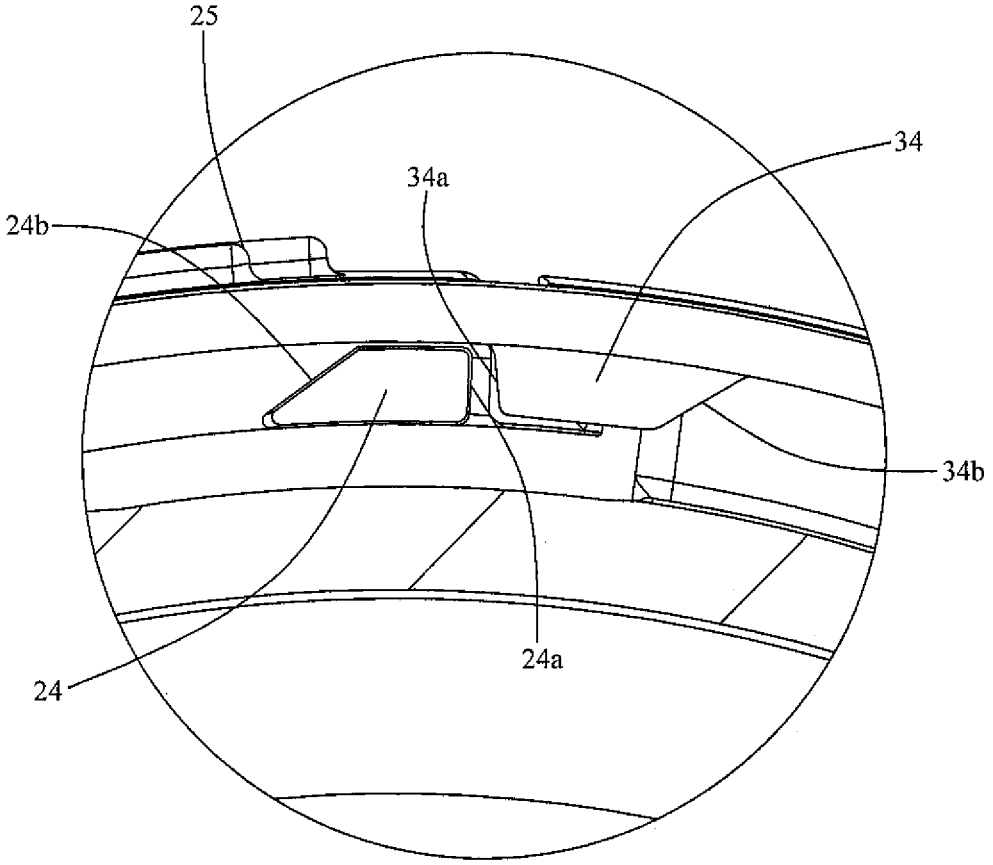
FIG. 8 shows the detailed view for highlighting locking between container with a cap of a child-resistant packaging in accordance with an embodiment of the present invention.

FIG. 7 and FIG. 8 illustrate sectional views of assembled container 20 with a cap 30 of a child-resistant packaging 10. In operation, the cap 30 will be screwed onto the container 20 to have a closed child-resistant packaging 10, the cap lugs 34 also have an angled/tapered surface **34*b* that are configured to contact an angled/tapered face 24*b* of the container/jar lugs 24 that will result in forcing the container lug(s) 24 inwards towards the body of the container 20 and as the cap lug(s) 34 passes the container's lug(s) 24, the container 20 and the cap 30 get locked together. Each cap lug also has a straight surface 34*a* that is on the opposite side of the cap lug's tapered surface 34*b*; likewise each container lug(s) has a straight surface 24*a* that is on the opposite side of the container lug's tapered surface 24*b*. When the container 20 and cap 30 are locked together, at least one of the cap lug's straight surface 34*a* and at least one of the container lug's straight surface 24*a* contact each other in order to inhibit undesirable unlocking rotation between the container and the cap when the container and the cap are to be locked together. This will inhibits a child from opening the packaging 10** on its own.

To unlock the child-resistant packaging 10, the depressor/pushing button 25 on container 20 should be pushed inward which permits the container lugs 24 to be transitionally moved toward the center of the container 20 which in turn permits jar lugs 34 to pass by the container lugs 24 when the cap 30 is simultaneously screwed off from the container 20.

The depressor/pushing button 25 will move into the cut out 23 in elongated neck of container and allows unlock the cap 20. The relief cut-out 23 allows the depressor/pushing button 25 to move inward to release the cap lugs 34 from the container lugs 24. The relief cut-out 23 causes the depressor/pushing button 25 to only be attached by a live hinge 27 that provides enough flexibility. The live hinge 27 flexes when the depressor/pushing button is pushed inward. The live hinge 27 further aids in bending of the depressor/pushing button 25 when it is pushed. It is designed to ensure that the button/depressor area flexes in evenly and doesn't twist.

Figure 9:
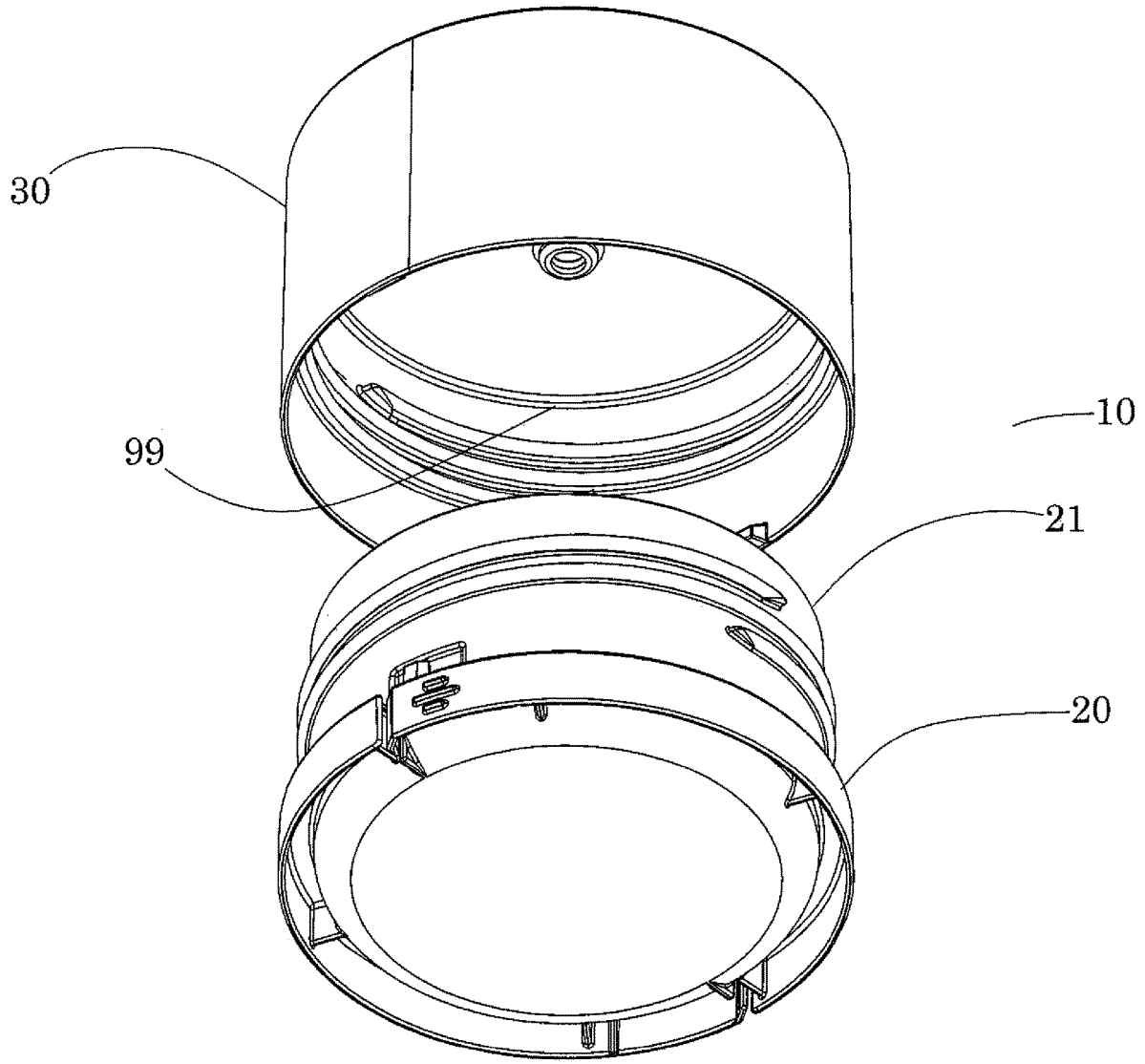
FIG. 9 illustrates the present invention with a neck seal.

Further, the cap's elongated hollow neck can comprises a neck seal 99, as shown at FIG. 9, to further inhibit the rotation of the cap lugs 34 past the locked position. With the neck seal, a second cap lug 34 is not necessary to inhibit the over-rotation of the cap lug 34, as the cap's bottom surface 390 contacts or nearly contacts at least a portion of the container's proximal surface 264 to inhibit the over-rotation so the cap lug 34 is positioned just past the container lug 24 when the container 10 is in a locked position.

The foregoing description of embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principals of the invention and its practical application to enable one skilled in the art to utilize the invention in various embodiments and with various modifications as are suited to the particular use contemplated.

The invention claimed is:

1. A child-resistant packaging comprising:

(A) a container with storage cavity defined by a first elongated hollow neck having a proximal opening that defines the storage cavity's opened end;

a distal extended closed bottom surface; and an outer diameter wherein between the proximal opening and the distal extended closed bottom surface is a portion of the outer diameter that has threads, wherein the distal extended bottom surface has (a) a bottom surface that closes the distal end of the container, and (b) a fixed circumferential ring that extends outwardly from the outer diameter and has a proximal surface and a distal surface; and a first elongated hollow neck cavity (a) on the outer diameter, (b) positioned between (i) the outer diameter's threaded portion and (ii) the bottom surface, and (c) having at least one container lug positioned between (i) the proximal surface and the distal surface and (ii) the outer diameter's threaded portion;

(B) a cap with a second elongated hollow neck having an inner diameter having a portion of the inner diameter threaded so the inner diameter threaded portion engages with the container's outer diameter threaded portion when the cap attaches to the container, a proximal closed top, a distal opening, and at least one cap lug positioned (a) on the inner diameter surface and (b) at or near the distal opening, (C) wherein, the container's extended closed bottom surface has (a) an extended bottom surface cavity that corresponds with the first elongated hollow neck cavity, (b) a living hinge is positioned in the extended bottom surface cavity, (c) the living hinge is capable of transitionally adjusting the at least one container lug from a locking state position to an unlocking state position by moving the at least one container lug toward the container's center when an appropriate force is applied to the living hinge; and wherein the cap releasably secures to the container when at least one cap lug passes over the container lug when the cap is screwed onto the container.

2. The child-resistant packaging of claim 1, further comprising: a first angled/tapered surface on the at least one cap lug and a second angled/tapered surface on the at least one container lug, wherein the first and second angled/tapered surfaces can contact each other, when the container lug is in the locking state position, prior to the cap locking onto the container.

3. The child-resistant packaging of claim 1, further comprising: a first angled/tapered surface on the at least one cap lug and a second angled/tapered surface on the at least one container lug, wherein (a) the first and second angled/tapered surfaces can contact each other, when the at least one container lug is in the locking state position, prior to the cap locking onto the container, (b) the living hinge is capable of being depressed and when the living hinge is depressed with a predetermined force then the container tab is transitionally adjusted from the locking state position to the unlocking state position to permit the cap lug to pass over the container lug so the cap locks onto the container.

4. The child-resistant packaging of claim 2, further comprising: a first angled/tapered surface and a first straight surface on the at least one cap lug wherein the first angled/tapered surface and the first straight surface are on opposite sides of the at least one cap lug; a second angled/tapered surface and a second straight surface on the at least one container lug wherein the second angled/tapered surface and the second straight surface are on opposite sides of the at least one container lug;

wherein the first and second angled/tapered surfaces can contact each other, when the at least one container lug is in the locking state position, prior to the cap locking onto the container and when a sufficient rotating locking force is applied, the first and second angled/tapered surfaces permit the at least one cap lug to slide over the at least one container lug so the first and second straight surfaces can contact each other to inhibit further rotation.

5. The child-resistant packaging of claim 1, wherein the at least one cap lug are attached to the second elongated hollow neck.

6. The child-resistant packaging of claim 1, wherein a at least one container lug is attached to the first elongated hollow neck.

7. The child-resistant packaging of claim 1, wherein the cap has a thinned-out portion at the distal opening wherein a lug ring is attached to the second elongated hollow neck.

8. The child-resistant packaging of claim 1, wherein the at least one cap lug has locator/attachment pins that attach to lug cavities on the second elongated hollow neck.

9. The child-resistant packaging of claim 1, wherein the living hinge is capable, when a sufficient force is applied, to push the at least one container lug inwards into the container.

10. The child-resistant packaging of claim 1, further comprising:

a first angled/tapered surface and a first straight surface on the at least one cap lug wherein the first angled/tapered surface and the first straight surface are on opposite sides of the at least one cap lug;

a second angled/tapered surface and a second straight surface on the at least one container lug wherein the second angled/tapered surface and the second straight surface are on opposite sides of the at least one container lug;

a neck seal on the second elongated hollow neck;

wherein the first and second angled/tapered surfaces can contact each other, when the at least one container lug is in the locking state position, prior to the cap locking onto the container and when a sufficient rotating locking force is applied or the at least one container lug is transitionally adjusted from the locking state position to the unlocking state position, the first and second angled/tapered surfaces permit the at least one cap lug to move in relation to the at least one container lug so the first and second straight surfaces can contact each other in a locked position and the neck seal inhibits further rotation of the at least one cap lug past the locked position.

11. The child-resistant packaging of claim 10, wherein the neck seal is configured to inhibit the rotation of the at least one cap lug past the locked position, thereby a second lug is not required to inhibit any over-rotation of the at least one cap lug.

12. The child-resistant packaging of claim 1, further comprising a cap seal ring to make the container air and moisture tight to keep products secure and in a desirable environmental condition.

* * * * *